US007131621B2

(12) United States Patent
Welzen

(10) Patent No.: US 7,131,621 B2
(45) Date of Patent: Nov. 7, 2006

(54) ANGULARLY ADJUSTABLE TREE STAND

(76) Inventor: Joseph Welzen, 26080 Bonita vista Ct., Sun City, CA (US) 92586

( * ) Notice: Subject to any disclaimer, the term of this patent is extended or adjusted under 35 U.S.C. 154(b) by 0 days.

(21) Appl. No.: 10/738,937

(22) Filed: Dec. 17, 2003

(65) Prior Publication Data

US 2005/0133683 A1 Jun. 23, 2005

(51) Int. Cl.
*F16M 13/00* (2006.01)

(52) U.S. Cl. ..... 248/514

(58) Field of Classification Search ..... 248/514, 248/515, 516, 519, 520, 523, 524
See application file for complete search history.

(56) References Cited

U.S. PATENT DOCUMENTS

| | | | | |
|---|---|---|---|---|
| 4,156,323 | A | 5/1979 | Scheffler | |
| 4,261,138 | A * | 4/1981 | St. George Syms | 47/40.5 |
| 4,381,621 | A | 5/1983 | Eby | |
| 4,408,415 | A | 10/1983 | Davis et al. | |
| 4,571,882 | A | 2/1986 | Capen | |
| 4,796,382 | A | 1/1989 | Anderson | |
| 4,913,395 | A | 4/1990 | Juhas | |
| 5,114,113 | A | 5/1992 | Krinner | |
| 5,161,768 | A | 11/1992 | Sarabin | |
| 5,209,450 | A | 5/1993 | Grapes | |
| 5,249,772 | A | 10/1993 | Montie, Jr. et al. | |
| 5,350,149 | A | 9/1994 | Evans, Jr. et al. | |
| 5,375,808 | A | 12/1994 | Roy | |
| 5,388,799 | A | 2/1995 | Keefe | |
| 5,507,117 | A * | 4/1996 | Kalman et al. | 47/40.5 |
| 5,522,177 | A | 6/1996 | Davis | |
| 5,707,037 | A * | 1/1998 | Pastrick | 248/516 |
| 5,845,890 | A | 12/1998 | Earsley et al. | |
| 6,010,108 | A * | 1/2000 | Welzen | 248/527 |
| 6,129,325 | A | 10/2000 | Niklas | |
| 6,357,173 | B1 * | 3/2002 | Sofy et al. | 47/40.5 |
| 6,681,519 | B1 * | 1/2004 | Cone | 47/40.5 |

* cited by examiner

*Primary Examiner*—Ramon O Ramirez
(74) *Attorney, Agent, or Firm*—Lewis M. Brande; Thomas A. McCleary; Brande and McCleary

(57) ABSTRACT

This tree stand assembly uses adjustable features for mounting a Christmas tree, other plants, bushes or a flag or similar banner pole in a vertical alignment. A pot is nailed securely to the bottom of the tree trunk. The tree is inserted into a cover, which fits over a wide bowl. The cover has a central hole with sloping inward sides to accept and guide the tree with attached pot.

The tree with pot is placed into the bowl, which captures the lower rim of a pot. This bowl acts as a water reservoir. It has a convex spherical bottom that mates with and contacts a lower base member, which has a slightly smaller radius concave upper surface. One slides the bowl on the base to make the tree stand vertically. The pot holds the tree and transfers side loads into the cover, which in turn transfers these forces to the bowl. The bowl resists these forces by contact with the spherical surface of the base, which in turn transmits these loads unto the floor surface.

9 Claims, 4 Drawing Sheets

ANGULARLY ADJUSTABLE TREE STAND

BACKGROUND OF THE INVENTION

1. Field of the Invention

This patent application relates to Christmas tree stands, especially by mounting the tree with a pot nailed to the trunk of the tree. The tree is then easily inserted into the stand. It is then a very simple task to adjust the stand to permit the tree to be erected to stand upright every time. One simply slides the bowl, containing the pot and the tree to an upright position. The bowl has a spherical bottom surface, and sits on a matching spherical to surface of the base. The bowl of the stand holds sufficient water to last the entire season, which keeps the tree green, reducing potential fire hazards.

It is a simple task to disassemble the tree at the end of the season and to drain the remaining water in the bowl, by simply pouring the water into a proper receptacle. The tree lot personnel can install the pot onto the tree trunk by pounding in some nails. This frees the purchaser from complex or time consuming assembly. All the purchaser is required to do is fill the bowl with water, put the cover onto the base, set the tree with the pot into the bowl, and make a final adjustment the bowl to straighten the tree.

2. Description of the Prior Art

Years ago, the tree stands consisted simply of two crossed boards. The bottom of the tree was sawed as straight as possible, and the trunk was nailed into the boards. With this simple design there were no provisions for a source of water. As time went on, a plastic bowl was placed on the boards and the tree bottom was nailed through the bowl. A soft mastic or waterproof roofing material was placed between the bowl and the boards to prevent water leakage. The tree was straightened by loosening the nails on the tilt side and the tree straightened. It was difficult to get the residual water out of the bowl at Season's end. In addition, the bowls occasionally leaked. The bowl, the cross boards and the tree were discarded at the end of the season. The cost of the bowl and boards was not recoverable.

U.S. Pat. No. 5,350,149 by Evans, Jr. et al. describes a tree stand having four legs of rigid material and rigidly interconnected. The invention consists of three rebar welded legs with a center spike, which is inserted into the bottom of the tree. A plastic bowl is placed below the legs of the tree stand. The rebar spike is threaded into the bottom of the tree trunk. If a hole is drilled into the bottom of the cut trunk, it must be drilled absolutely in line with the centerline of a straight upright tree to accept the spike. If the hole is drilled crooked, the assembly has to be pulled, rotated, or pounded loose and that is a major chore since the spike is threaded into the base. Next, the drilled hole has to be plugged and re-drilled, or the trunk cut off, re-drilled and the rebar stand threaded back in. When it is time for the homeowner to remove the stand, that is a major problem. The task is so difficult that many just throw out the stand with the tree.

A variation of the aforementioned tree stand uses three rebar welded legs with a center spike, which is inserted into the bottom of the tree. A plastic bowl rests on top of the rebar. The plastic bowl has a center hole in the bottom with a rubber grommet attached. The rebar spike is pounded through the grommet and hole in the bottom of the trunk of the tree. The tree trunk must be cut absolutely straight across perpendicular to the centerline of an upright tree, since the trunk bottom rests on the bowl and top of the rebar. The hole that is drilled into the tree trunk must be drilled absolutely in line with the centerline of a straight upright tree to accept the spike. The spike may be partially serrated with horizontal grooves to hold the tree firmly in place. If the hole is drilled off center, the assembly has to be pulled, rotated, or pounded loose which is a makes correct orientation of the tree difficult since the serrations dig into the tree. Then, the drilled hole has to be plugged and re-drilled. If the drilled hole is not plugged, the tree trunk must be cut off above the drilled hole, re-drilled and the spike hammered back in.

When the homeowner wants to remove the stand, he encounters a major difficulty. Just removing the spike from the tree trunk is such a difficult task, many owners just throw out the stand with the tree. That expense is not recoverable. The grommet that is supposed to prevent leaking would sometimes leak damaging the floor or carpet. Removing the remaining water from the bowl at the end of the season is very difficult and time consuming. An owner has to use sponges and towels to extract the water and rinse out the bowl. Another problem with the stand is that the ends of the rebar dig into the floor or carpet causing the owner to buy plastic caps or pads to prevent the rebar from scraping over the floor. The stand cannot be conveniently moved or rotated without lifting it up. It is not uncommon for the tree stand to damage the flooring that it is placed upon.

Another design as in U.S. Pat. Nos. 4,913,395; 5,209,450; 5,249,772; and 5,388,799 uses a small bowl with a spike at the bottom, a metal ring went around the top of the stand and four drop hammered metal legs were held by this ring. To support the tree, four opposing screws were turned against the tree trunk. The tilt of the tree was adjusted by loosening one or two screws on one side and tightening one or two screws on the opposite side. This was extremely difficult to do since one had to be down low on the floor. It really required two people, one to hold the tree up straight and one to tighten the screws. The bowl didn't hold enough water to keep the tree from drying out during the entire Christmas/New Year's season. The screws were difficult to adjust properly and the stand could only hold small trees.

A number of tree stand designs U.S. Pat. Nos. 4,571,882; 4,408,415; and 4,156,323 use a ball and socket device to get the tree to stand up straight. All of these use complicated mechanical means of holding and adjusting the tree trunk. They work primarily for smaller type trees and all of them do not have a sufficiently large water reservoir.

Several other tree stand designs U.S. Pat. Nos. 4,381,621; 5,161,768; and 5,522,177 incorporate vertical support members with various tree trunk securing members to position and support the tree. These supports are generally adjacent to the tree and take up a wider "footprint" than the other, more traditional stands. They also do not have large water reservoirs.

Yet another popular design as seen in U.S. Pat. Nos. 4,796,382; 5,114,113; 5,375,808; and 5,845,890 use clamping devices with or without a spike in the receiving water reservoir to position and support the weight of the tree. The orientation of the tree is dependent upon the position that the tree is in when the clamping devices are activated. Most of these designs incorporate small water basins.

A rather unique design, U.S. Pat. No. 6,129,325, uses a system of inflatable bellows together with a support spike in the water reservoir to position the tree. This design, once again, has a small water container.

The previous patent by Welzen, U.S. Pat. No. 6,010,108 used a sliding clip device to hold the nails. This device was not strong enough to withstand loads imposed on them when the tree was installed and positioned. The stand used a one-piece blow molded container, which was expensive to manufacture, took up a lot of space and increased the cost of shipping and storage. This design did not have a removable top for easy cleanup of water at the end of the Christmas season. Nor did it have sloping inward sides that guide the tree into the attached pot.

With the exception of the previous patent by Welzen, all previous tree stands did not hold sufficient water to keep the tree green all season long to reduce the fire hazard. All are complicated with many manufactured detailed parts. They make it difficult to set up the tree and to take it down.

SUMMARY OF THE INVENTION

The present invention solves the aforementioned problems. The bottom of the tree does not have to be trimmed straight. The holes drilled into the bottom of of the tree do not need to be drilled straight and normal. All that must be accomplished with the present invention is to insert a small spike through a guide defined in the base of the pot and into the base of the tree. This will prevent the pot from sliding. Four nails will then be inserted through a curved lip of the pot and into the trunk of the tree. This will hold the tree very securely to the pot. The tree lot personnel can do this set up work.

The customer takes home the tree and pot. The base is located on the floor where the tree will be erected. A large bowl, which may hold 3 gallons of water, is placed on top of the base. After the water is poured in, a cover is placed over the bowl. The cover has a central hole to match the pot shape. The inner lip of this hole slopes down and inward to match the sides of the pot. The inward sloping lip acts as a guide to aid in inserting the tree and pot into the stand.

Next, the tree is straightened by sliding the bowl, with its spherical lower surface on the spherical upper surface of the base to correct the slant of the tree trunk. At the end of the season, the tree and pot are lifted out of the bowl, dried and then discarded. The bowl, containing residual water, is picked up and poured into a proper receptacle. The cover is then placed on the bowl, and the stand is stored for use next year.

Besides the objects and advantages of the above mentioned invention, there are several additional objects and advantages to the current invention:

(a) to provide a tree stand that is easy to set up and to stand straight;

(b) to provide a tree stand that is easy to take down at the end of the season;

(c) to provide a tree stand that holds sufficient water to last the entire season, thus keeping the tree green, which reduces the fire hazard;

(d) to provide a bowl that is easy to empty at the end of the season;

(f) to make it easy to install a pot to the base of the tree by using four nails;

(f) to make it easy to keep the tree from sliding in the pot by means of a spike driven through the bottom of a pot guide and into the tree;

(g) to make it easy to insert the tree into the stand by using a sloping downward rim around the hole opening of the cover that matches the pot sides, making it easier to guide and install the pot into the stand;

(h) to have a raised ring around the bottom of the pot area to firmly keep the pot with tree, from sliding sideways;

(i) to have an inwardly slanted ramp area at the top of the raised ring to engage the lower outer edge of the pot to guide it into position, thus making it easier to install the tree where visibility to see the pot behind the branches is limited;

(j) to design the parts so they can be easily vacuum formed from standard sheets;

(k) to design the parts so they may also be injected molded using a suitable plastic such as HDPE.

(l) to design the parts to be symmetrical about the center line for easy manufacture;

(m) to design in a suitable draft on all parts to allow the parts to be pulled easily from the vacuum form mold, or from the injection molded machine;

(n) to design the pot to be injected molded to reduce piece price;

(o) to design the upper lip of the pot so that it extends out and down to provide two guide holes to insert the nail to hold it true and steady when being pounded into the tree;

(p) to design the pot lower lip to be positioned just a small clearance above the cover surface to keep the cover down in the event unusual circumstances want to lift the cover when the tree is attached;

(q) to design the parts with sufficient draft so they can be readily stacked for minimum shipping volume, thus reducing the costs of the parts;

(r) to design the tree stand to eliminate machined parts that are difficult to manufacture;

(s) to design a tree stand that has no moving mechanical parts that can wear or break;

(t) to provide a return lip around the bottom lip of the base so the tree with stand can be slid on the hard floor or carpet to a new location as desired;

(u) to provide round parts to allow the tree to be rotated to install and remove decorations and lights and to show off the best branches;

(v) to design the pot so that the nails see only side loads and no axial loads;

(w) to design the pot so that at least two nails are resisting side loads at all times;

(x) to use a spherical radius at the bowl bottom with a pivot approximately one third of the way up on a tree. For example, with a nine foot tree (108 inches), the spherical radius of the bowl is set at 36 inches with the matching spherical radius of the base being set at a smaller radius such as 34 inches or smaller from the identical above pivot point;

(y) to provide a means of catching spilled water unto the base upper spherical shape and to the raised outer lip of the base.

(z) to provide a plastic cloth to be placed on the floor upon which rest the base of the stand. To easily move the stand with tree installed, by gripping the edge of the cloth and pulling it in the direction that the stand must go. This cloth, preferably white in color can also be folded up around the base to disguise the stand.

(aa) a pot to hold the tree, which has a plurality of holes in the bottom to allow water to come up into the pot to water the tree. These same holes allow water to gush into the pot at the time the tree is inserted into the stand. At the end of the season, these holes allow the residual water to drain out freely as the tree is lifted out.

DETAILED DESCRIPTION OF THE INVENTION

Figure 2:
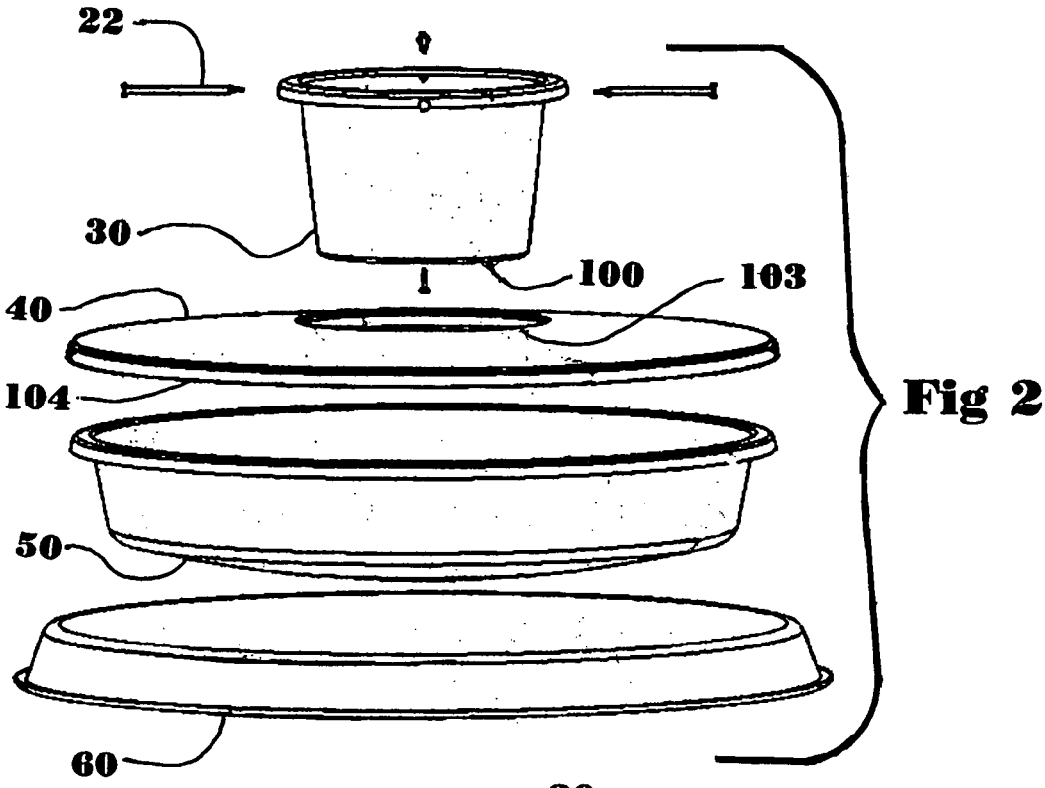
FIG. 2 shows an exploded view of the components of the tree stand. The spike at the bottom of the pot is shown in the cross section of FIG. 5 and FIG. 6.
Figure 1:
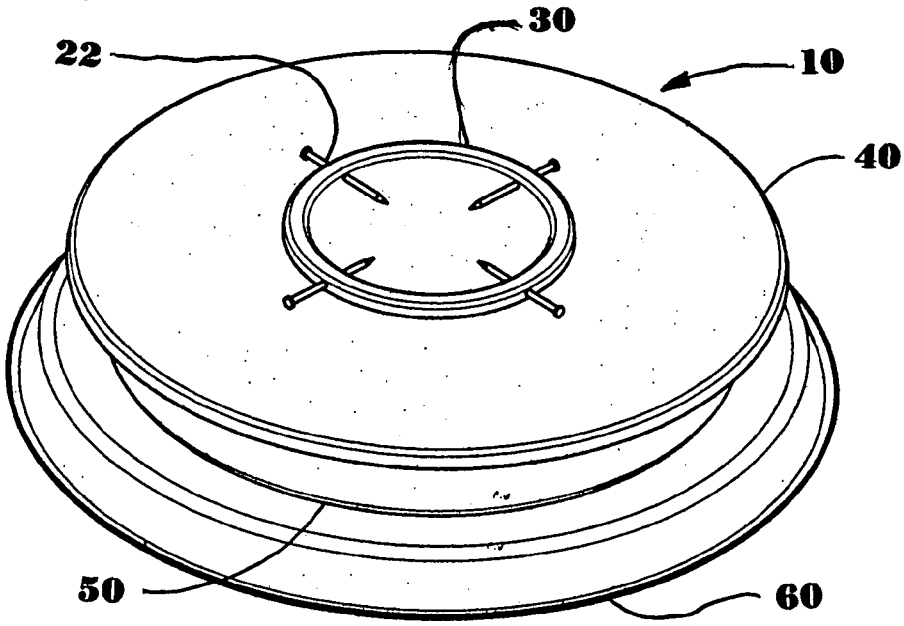
FIG. 1 is an isometric view of the tree stand showing relative positions of the components of the assembly.
Figure 3:
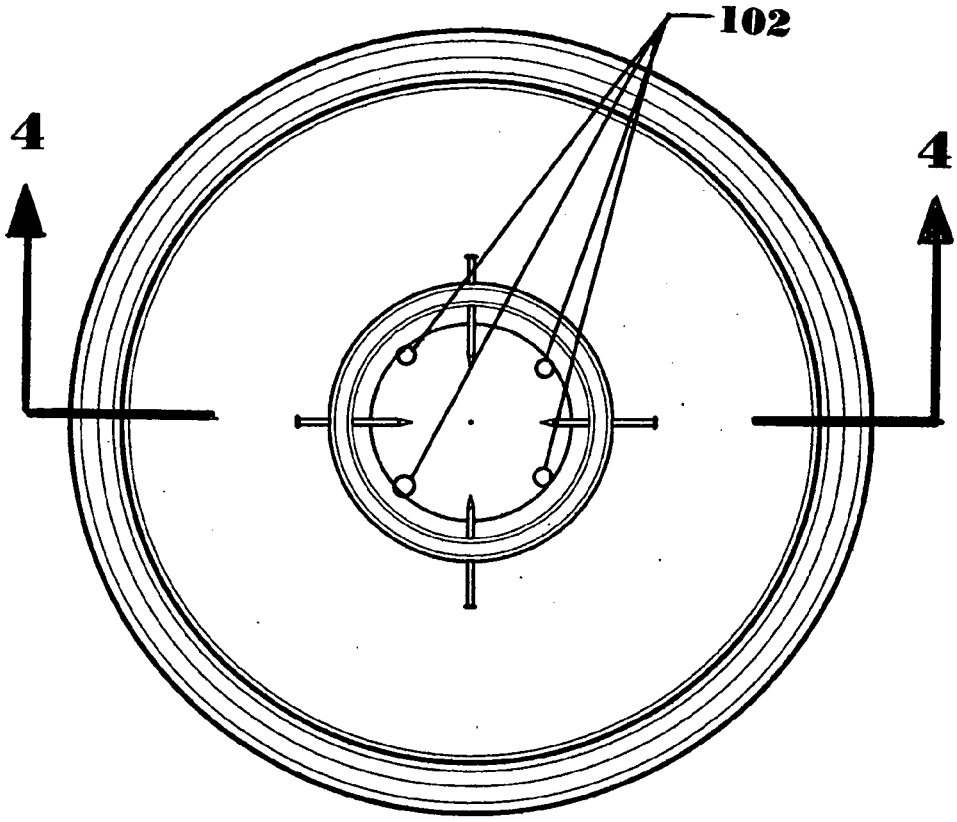
FIG. 3 is a top view of the tree stand assembly.
Figure 4:
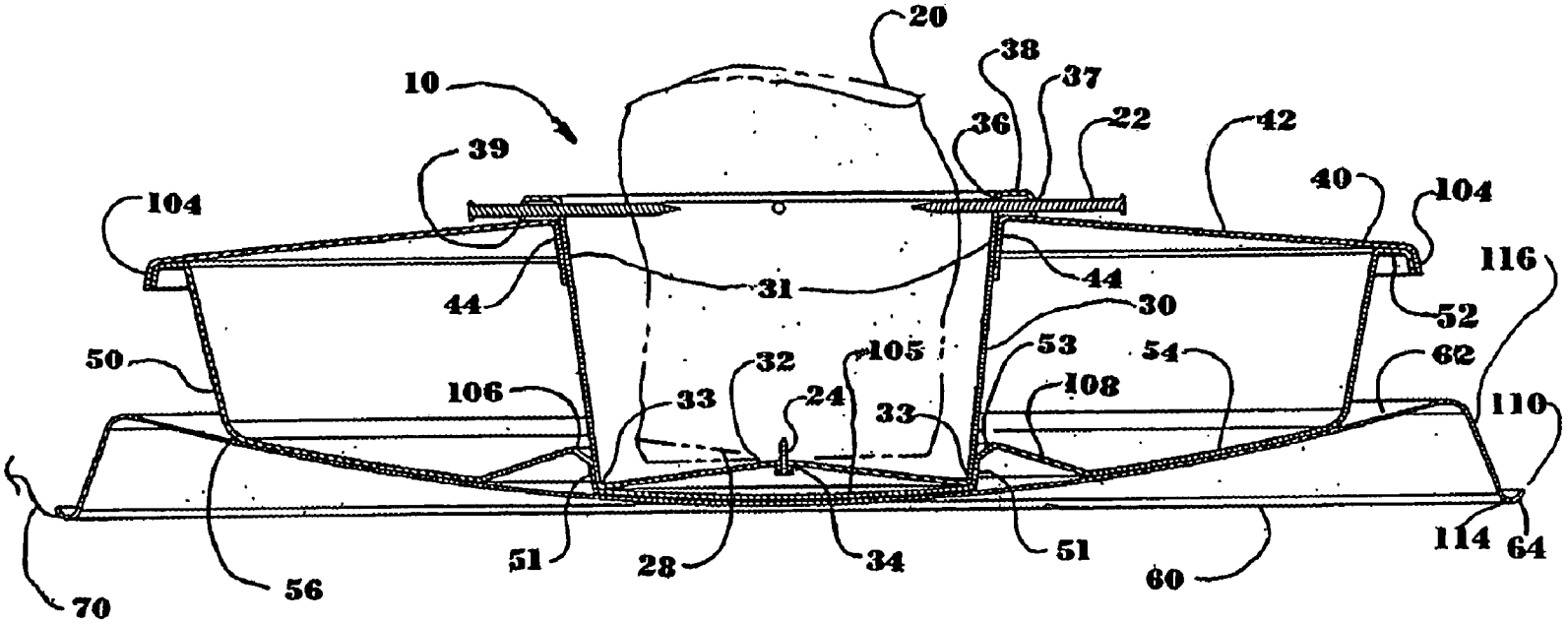
FIG. 4 is a side view of the tree stand assembly. The cross section of the assembly is taken at Section line 4—4.
Figure 5:
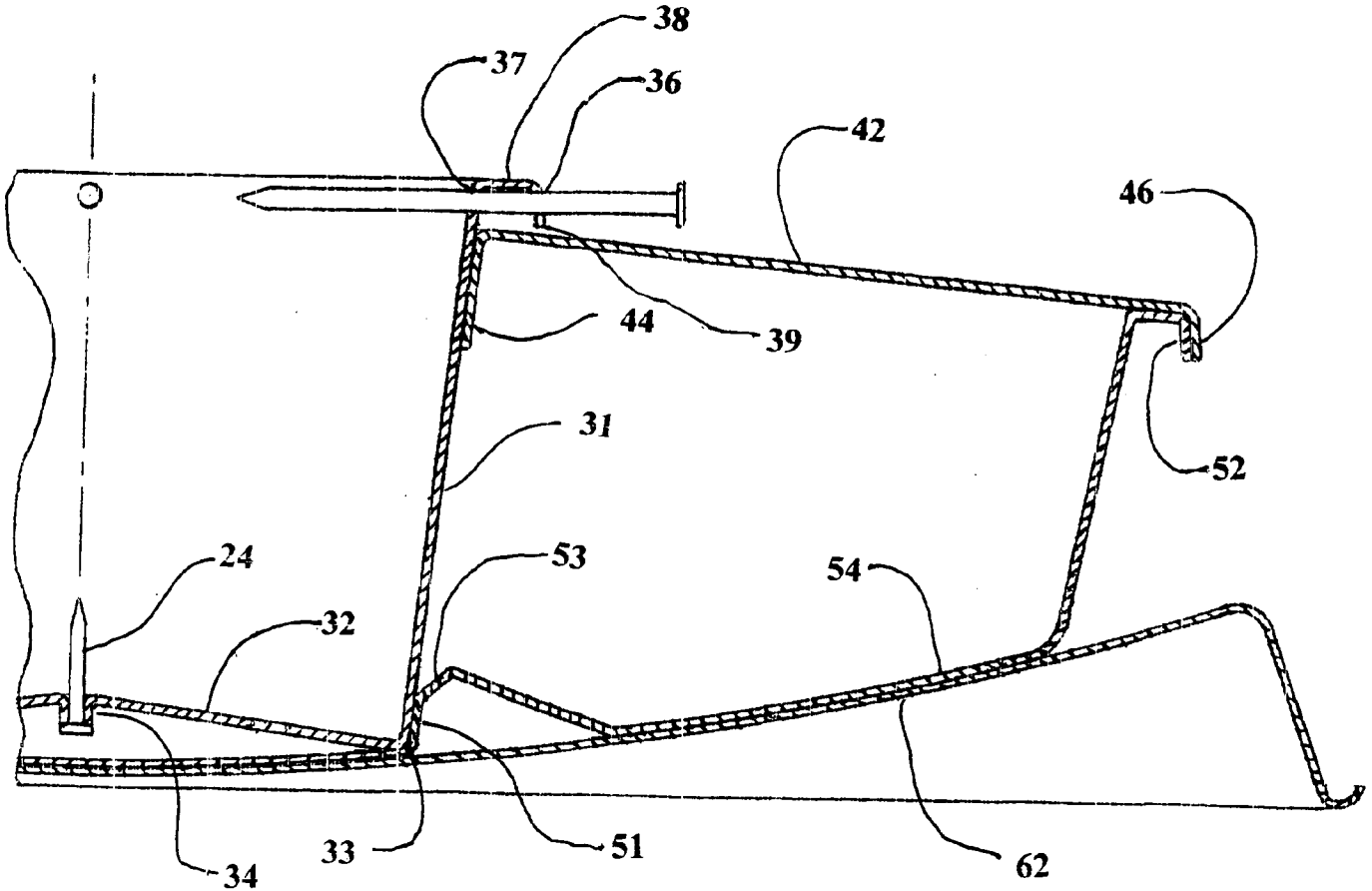

Refer to FIG. 4. a stand assembly (10) is shown with all components in their relative positions. The lower trunk of the tree (20) is shown in phantom. The end of the tree (20) is held from sliding sideways by a spike (24). The spike (24) is driven through an extended cylindrical section (34) of a pot (30) and into the tree (20). The extended cylindrical section (34) is located at the bottom(100) of the pot (30). The extended cylindrical section (34) locates the spike (24) centrally and acts as a guide and holding device while the spike (24) is inserted and driven into the base of the tree (20). It is not necessary that the tree trunk (26) be sawed off absolutely straight since the dome shape (32) of the pot (30) allows for the insertion of a non-straight cut (28) of the tree (20). The pot (30) generally has a circular cross section, the circular cross section tapering towards a bottom (100) of the pot (30), an upper rim (38) of the pot (30) having a larger circular cross section than the bottom (100) of the pot (30). The circular cross section of the pot (30) allows the tree (20) to be manually rotated within the stand assembly (10) for best viewing.

The bottom (100) of the pot (30) has a plurality of holes (102) defined therein, the plurality of holes (102) allowing water to keep the tree (20) moist when the tree (20) is in the stand assembly (10), the holes (102) also allowing water to drain away from the pot (30) when the tree (20) and pot (30) are inserted into the stand assembly (10)

Four nails (22) are equally spaced radially around the pot (30) and are driven into the tree trunk (20) using guide holes (36), (37), the guide holes (36), (37) generally being horizontally aligned, and may oppose each other. The guide holes (36), (37) support the nails (22) and allow the nails (22) to be driven and positioned easily toward the center of the tree (20). The nails (22) are driven into the tree trunk (20) deep enough, approximately one inch, to grip the tree (20) firmly to resist side loads only. The nails (22) are located close to the upper rim (38) of the pot (30), allowing the side loads on the nails (22) to be easily transmitted to the upper rim (38), and thereby into the sloping sidewalls (31) of the pot (30).

The lower outer rim (39) of the pot (30) is designed with an approximate 0.032 inch (0.8128 mm) clearance from a cover (40) to act as a safeguard, should the cover (40) for some reason lift up and out. The lower outer rim (39) of the pot (30) prevents the cover (40) from lifting up while the tree (20) is in the stand (10). The cover (40) has a central opening (103) defined therein, the central opening (103) being circular in shape. The cover (40) has a sloping upper surface (42), which terminates into a down and outward slanted lip (104). The down and outward slanted lip (104) slips over a downward outer sloping rim (52) of the bowl (50) with a snug fit.

The loads transmitted to the sloping walls (31) of the pot (30) are reacted by the sloping inward lower flange (44) of the cover (40). The loads then travel to the cover (40) opposite of the tree load P1 and are introduced into the downward outer sloping rim (52) of the bowl (50). The load is then transmitted to the lower spherical surface, or downward convex bottom surface (54) of the bowl (50), where it is transmitted into the upper spherical surface, or downward concave top surface (62) of the base (60). The load then travels into the outer return lip (64) of the base (60) and is resisted by friction with the floor surface. The outer return lip (64) of the base (60) also resists the downward weight of the tree (20) and the water and transmits it to the floor surface in a downward direction. All this load transfer explanation is shown to illustrate why the component features are designed in the special manner in which they are.

The base (60) has a downward and outwardly sloping outer wall (116) or sloping outer wall, where the sloping wall (116) provides support for the base (60). The outer return lip (64) further has an upward turned flange (110). The upward turned flange (110) is distally positioned from the sloping outer wall (116) of the base (60) creating a trough (114) therebetween. The trough (114) entraps liquid spilled from the bowl (50).

If the tree (20) is accidentally tipped or tips due to an unbalanced weight distribution of the tree (20), the tipping load is introduced into and pivots about the outer lower corner (56) of bowl (50) where the load is resisted by the upper spherical surface (62) of the base (60).

The tipping load also pivots about a lower corner (33) of the pot (30). This pivoting tipping load of the pot (30) is resisted on the opposite side by a raised rim (51) of the bowl (50). The raised rim (51) has to be high enough to prevent the lower corner (33) of the pot (30) to slip out of the raised rim (51).

The bowl (50) has a central ring (106). The central ring (106) has a raised portion (108) said raised portion (108) has an inward slanting ramp (53). When the tree (20) and pot (30) are inserted into the stand assembly (10), the slope of inner downward lip (44) is deep enough guide the pot (30) into the bowl (50). As the pot (30) approaches the bowl bottom (105), it could be tilted slightly. If this occurs, the inward slanting ramp (53) of the bowl (50) contacts the lower rim (33) of the pot (30) and directs it down the inward slanting ramp (53) and into the raised rim(51) where it is held snugly.

The bowl (50), the cover (40), the pot (30), and the base (60) have sufficient draft allowing them to be stacked, which saves on shipping costs. The draft also allows the parts to be released easier from the production machinery thereby reducing wear on the machinery surfaces.

As heavier and larger trees are purchased, the stand assembly (10) may embody additional stiffening members in the cover (40), the bowl (50) and the base (60) to accommodate the larger, and heavier trees. The additional stiffening members may be either additional thickness of the parent material of the cover (40), the bowl (50) and the base (60) or by the addition of stiffening pillow ribs in the bottom of the bowl (50).

The parts can be fabricated by an injection molding process, where the part can be selectively made thicker and stronger, as necessary, in required areas. Gussets and ribs may be added to the cover (40), the bowl (50) and the base (60) to accommodate critically stressed sections of the design.

An alternate design of the downward convex bottom surface (54) of bowl (50), is to modify the smooth surface of the downward convex bottom (54) of bowl (50) by creating a segmented raised bottom comprising quadrants or segments that may have a half inch of space between each of the quadrants which simulates the downward convex bottom surface (54) of bowl (50).

Another alternate approach to the spherical surface of the bowl is to use a flat or slightly raised bottom where only the outer end area of the rim of the bowl slides on the spherical surface of the base.

In lieu of nails (22), a long screw, which may be slightly larger than the nails (22) may be used. The shank of the screw would have the same diameter as the nails and the end portion would be threaded for a one inch distance. The screw may have a flattened thumbscrew head, which could be used to pound in the screw to engage the threads and finish up by turning the threads for engagement;

In lieu of the spike (24), a regular plated screw of a one inch length with equivalent diameter as the spike (24) may be used.

Note that the parts can be generated, by using one half of the cross section and rotating it around the centerline of the assembly.

Another alternate design of the base (60) is to use members that would approximate the shape of the spherical downward concave top surface (62) of the base (60). This would consist of components such as curved spoke-like tubing, or circular ringed tubing set to match a spherical shape. These may be made of materials such as metal or plastic. These curved beams would have the same radius of curvature as the downward convex bottom surface (54) of bowl (50). The bowl (50) could slide on these segments of a simulated spherical downward concave top surface (62) of the base (60) or any other portion of a spherical surface used.

What is claimed is:

1. An adjustable stand assembly, said adjustable stand assembly adapted to mount a workpiece, such as a tree, to stand upright in a vertical orientation, comprising a stand assembly, a cover, a bowl and a base; wherein:

a. said stand assembly has a pot, said pot adapted to be being firmly attached to the base of a tree trunk;

b. said cover has a central opening defined therein, said central opening being adapted to receive said pot; said cover has a sloping upper surface, said sloping upper surface terminating into a down and outward slanted lip, thereby making it easier to install said cover snugly over and enclosing said bowl;

c. said pot is circular in cross section and has at least two guide holes defined therein, said guide holes being located towards an upper rim of said pot, said guide holes being positionally opposed to each other, said pot being adapted to attach to the tree by means of a plurality of holding devices, said plurality of holding devices equaling said guide holes defined in said pot, said plurality of holding devices being selected from the group consisting of nails, screws, tapered bolts, pointed or unpointed metal rods;

d. said plurality of holding devices being guided by said guide holes, into the tree, said guide holes being horizontally aligned;

e. said pot further having a plurality of holes defined therein, said plurality of holes being biased towards a bottom of said pot, whereby said plurality of holes allow water to enter said pot and drain said pot of water when the tree is lifted out of said stand assembly;

f. said bowl has a downward curving convex bottom surface, said downward curving convex bottom surface having said cover attached thereon, said bowl additionally having a means of retaining said pot, said bowl further having a downward outer sloping rim, said downward outer sloping rim having adapted to have a snug fit with said down and outward slanted lip of said cover; and g. said base has a downward curving concave top surface defined therein, said downward curving convex surface of said bowl mating with said downward curving concave top surface of said base, said base having a return lip, said return lip being located at an outer edge of said base facilitating moving said stand assembly with the tree mounted therein, thereby.

2. The stand assembly of claim 1, wherein;

said cover central opening being circular in shape, said cover further having a downward circular sloping surface to accommodate said pot, said pot having sloping sidewalls, said sloping sidewalls having a decreasing circular cross section towards said base of said pot;

said circular sloping surface of said central opening of said cover guides said pot when said pot is placed into said stand assembly;

said lower flange of said central opening of said cover is adapted to hold said pot firmly and accepts side loads from said pot shaped member when the tree is tipped.

3. The stand assembly of claim 2, wherein:

said cover has a circular shape aiding in manufacture of said cover, said circular central opening in said cover is adapted to allow said pot to rotate therein.

4. The stand assembly of claim 1, wherein:

said bowl is circular in shape, said bowl has an outer extended downward slope of a rim, said outer extended downward slope of a rim of said bowl matches said down and outward slanted lip, said down and outward slanted lip being located on said cover.

5. The stand assembly of claim 1, wherein:

said bowl has a central ring, said central ring has a raised portion, said raised portion of said central ring is adapted to receive an outer base of said pot, guiding said outer base of said pot by an inward slanting ramp, securely holding said pot therein.

6. The stand assembly of claim 1 wherein:

said downward curving convex bottom surface of said bowl is spherical in shape and rests upon a corresponding concave spherical surface of said base, whereby the spherical radius center of the bowl is set at the approximate center of gravity of a nine foot tall tree.

7. The stand assembly of claim 1, wherein:

said downward concave top surface of said base is spherical in shape with the spherical radius smaller than the radius of said bowl, allowing said outer rim of said downward concave top surface of said bowl to contact said downward concave top surface of said base first, whereby a stabilizing said stand assembly, preventing said bowl from rocking on said base; and said downward concave top surface of said base extends out and beyond said downward concave top surface of said bowl.

8. The stand assembly of claim 1, wherein:

said base has a downwardly and outwardly sloping outer wall, said downwardly and outwardly sloping outer wall has a return lip, whereby said return lip allows said base with said bowl, said pot, and the tree to slide along a floor repositioning the tree;

said outer return lip further has an upward turned flange defined thereon, said upward turned flange is distally positioned from said downwardly and outwardly sloping wall of said base creating a trough therebetween, said trough being adapted to entrap liquid spilled from said bowl.

9. The stand assembly of claim 1, wherein:

said pot, said cover, said bowl, and said base all have sufficient draft to allow each component to be stacked atop itself, whereby there is reducing shipping volume and reduced costs of shipping, storage and floor space.

* * * * *